United States Patent [19]

Van Kuiken, Jr.

[11] 4,239,804

[45] Dec. 16, 1980

[54] METHOD FOR TREATING METAL ARTICLES FOR RUST CORROSION PROTECTION AND ARTICLE PRODUCED THEREBY

[75] Inventor: Lewis L. Van Kuiken, Jr., Grand Rapids, Mich.

[73] Assignee: Progressive Blasting Systems, Grand Rapids, Mich.

[21] Appl. No.: 17,416

[22] Filed: Mar. 5, 1979

[51] Int. Cl.[3] ..... B32B 15/04

[52] U.S. Cl. ..... 428/409; 428/432; 428/457

[58] Field of Search ..... 432/432; 428/457, 409

[56] References Cited

U.S. PATENT DOCUMENTS

| | | | |
|---|---|---|---|
| 3,922,433 | 11/1975 | Patterson et al. | 428/432 X |
| 4,039,997 | 8/1977 | Kuang et al. | 428/432 X |

*Primary Examiner*—Thomas J. Herbert, Jr.

*Attorney, Agent, or Firm*—Price, Henevald, Huizenga & Cooper

[57] ABSTRACT

A method for treating an article having rust corrosion characteristics in which the article is dry-blasted by the propulsion of glass beads to compressibly peen the surfaces of the articles and thereafter preferably applying a protective coating to the peened surface. The glass beads are preferably blasted against such surfaces by pneumatic propulsion and are of a mesh size falling within the range of 70–140 mesh. Also, preferably the intensity of the glass beads striking the surface of the article is controlled so than an Almen test strip "N" subjected to the same blasting procedure shall show an Almen gauge reading of 0.005–0.007 inches. This invention encompasses an article treated specifically for the purpose of corrosion protection employing the above method.

14 Claims, 4 Drawing Figures

METHOD FOR TREATING METAL ARTICLES FOR RUST CORROSION PROTECTION AND ARTICLE PRODUCED THEREBY

BACKGROUND OF THE INVENTION

The prior art method of treating metallic articles of high corrosive characteristics has been to apply some method for solely removing the mill scale, the heat treat scale, the rust, and other surface contaminates and thereafter applying a protective coating to the cleaned surfaces. The cleaning step has been done predominantly by the so-called "acid pickling" method although in some instances where there are very little surface contaminates, the surfaces have been cleaned by other methods such as by tumbling in a media which by reason of the media's tumbling over the surfaces eventually cleans the surfaces of the articles to be protected against corrosion.

In these prior methods, the sole purpose and intention of the method was to clean the surface of the scale, rust and other contaminates so that the protective coatings would adhere more readily and with greater tenacity.

These methods of treating metallic articles for corrosion protection have all left a great deal to be desired in the protective characteristics of the metallic articles after such treatment. Therefore, there has been a demand for some time for a new method for treating metallic articles to give them adequate corrosion protection.

In an entirely unrelated art to that of rust corrosion resistance there have existed for some time methods and apparatus for treating parts which required high fatigue and high stress resistant characteristics. Such articles, for example, are the vanes and other parts used in jet engines for which the United States government has set high standards for treating such components by blasting the surfaces thereof with small particles so as to peen the surfaces in order to reduce the incidences of fatigue and stress failure. An example of such procedures is found in the U.S. Government Specification entitled *Military Standard Glass Bead Peening Procedures* NIL-STD-852 (USAF) Sept. 21, 1965. Another example of such procedures established by private industry is the Society of Automotive Engineers Aerospace Material Specification #AMS 243 OH. Although such glass peening procedures as disclosed in the above cited documents have been in existence for a number of years as evidenced by the 1965 date of one of the documents cited above, no one to my knowledge has ever conceived, prior to the present invention, of treating articles for rust corrosive resistance by blasting the part to be treated with glass beads.

THE PRESENT INVENTION

In accordance with the present invention, I have conceived of improving the anti-corrosive characteristics of a normally corrosive metal by actually blasting the surfaces of the article with propelled glass beads to such an extent that the glass beads not only remove the scale, rust and other surface contaminants, but actually the surface is compressively peened, resulting in a surface with unusual anti-rust-corrosive characteristics.

I have discovered that a surface treated by my method has several unusual and unexpected characteristics including the compressive nature of the surface which in itself resists rust corrosion so that even without a protective coating, the article is substantially more anti-corrosive.

Another characteristic of such treated surface is its physical profile as viewed under a microscope which assists in excellent coating or plating adhesion.

Another characteristic of the surface treated in accordance with my method is the provision for a more active surface for accommodating chemical reaction with the coating and/or plating, thereby assisting in achieving excellent bonding between the metal part and the coating or plating.

Other characteristics of an article treated in accordance with my method is that the surface under compression has reduced fatigue and stress failure possibilities thereby increasing the fatigue life of the article so treated. In addition, the uniform surface produced by the peening of the surface provides a more uniform surface which will assist in providing a more uniform torque if the article is to be used in resisting torque forces exerted thereon.

Finally, as opposed to the treatment by the predominant method of acid pickling, the possibility of hydrogen embrittlement is completely eliminated.

In accordance with my method, I preferably use glass beads blasted by pneumatic propulsion, the beads having a mesh size falling within the range of 70–140 mesh. Further, I have discovered that the intensity of the glass beads striking the surfaces of the article should fall within a certain range. That range, as determined by a well-known Almen test is that an Almen test strip "N" subjected to the same blasting procedure should show an Almen gauge reading of 0.005–0.007 inches.

For a more specific description of my method and the article produced thereby, reference is made to the description below made in conjunction with the appended drawings.

Figures 1, 2:
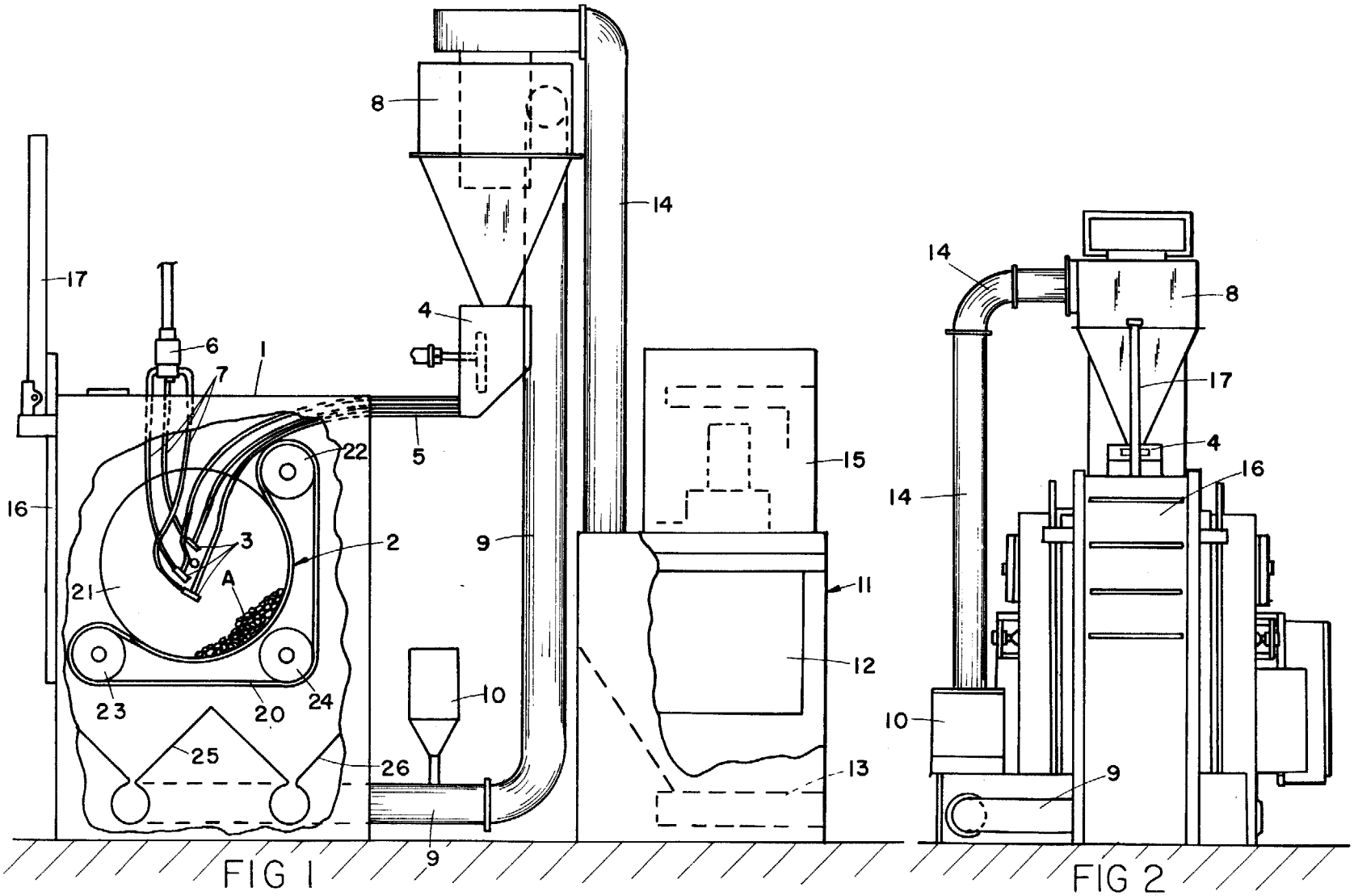
FIG. 1 is a side elevational view of a sketch of the apparatus used in the present invention and in conjunction with which the method will be described.
FIG. 2 is a front elevational view of the same equipment as disclosed in FIG. 1.

Referring specifically to the drawings, FIG. 1 discloses a housing 1 having a door 16 with an air cylinder opener 17. Located in housing 1 is the tumbler mechanism 2 in which the articles A are tumbled while they are being blasted by a plurality of blasting guns 3 (only three of which are shown for simplicity sake). The blasting guns 3 are fed the glass beads from the hopper 4 through the plurality of tubes 5, one for each of the guns 3. The guns 3 are in communication with a source of pneumatic air 6 through the tubes 7. The air flowing through the tubes 7 passes through a venturi located in the gun 3 which draws the beads into the gun and then propels or blasts them against the articles A.

Also comprising the entire system is the cyclone separator 8, which separates the beads into a predetermined mesh range as will be described hereinafter, a dust bag house 11, for handling the dust formed by the broken and shattered glass beads; the sound control chamber 15; the ducts 9 and 14; and the virgin glass bead adder 10.

The beads are fed to the cyclone separator 8 through the duct 9 which carries both the reclaimed glass beads from the housing 1 and also the virgin glass beads added to the system by the automatic virgin glass bead adder 10. The dust bag house receives the smaller fines of the glass beads through the duct 14 from the cyclone separator 8. All of the equipment described above which has been in existence for some time is quite conventional.

Referring specifically to the tumbling apparatus 2 in the housing 1 of FIG. 1, it will be noted that the articles A, such as screws and the like, are tumbled on a webbing or belt 20 which is mounted on 36" diameter spaced wheels 21 located near two opposite sides of the housing 1. The webbing 20 spans the space between the two wheels or discs and has 4" long slits about ⅛" wide on the entire webbing. It passes over the pulleys 22, 23, and 24 to form a continuous perforated belt through which the glass beads will pass. In the tumbling mode in which the belt is moving in a direction so that the discs or wheels 21 are rotating counterclockwise, the articles are being continuously carried upwardly and then dropped down. During this mode, the guns 3 are blasting the glass beads against the articles in various different directions. The glass beads then pass through the webbing 20 into the chutes 25 and 26 from whence they flow into the duct 9 after which they are carried upwardly to the cyclone separator 8.

An important aspect of this invention is the type and mesh size of the glass beads used to blast the surfaces of the articles. I have discovered that glass beads in the range of 70-140 mesh have proven to be the most effective for peening the surfaces of the articles. However, in some cases, glass beads falling in the range of 30-200 mesh can be used.

The type of bead I have found to be suitable in practicing my invention are sold in the trade under several different trademarks. One of these is sold under the trademark "BALLOTINI" by Potters Brothers of Carlstadt, N.J. The size AD in the BALLOTINI catalog falls within my preferred range and is found to work satisfactorily. Another brand of glass beads are those sold under the trademark "MICROBEADS" by Catophote Ferro Corporation of Jackson, Miss. The size of bead found in Cathophote Ferro Corporation catalog which also falls within my preferred range is identified by MS-MH.

In order to assure the proper glass bead mesh of the virgin glass beads used in the method, for each 1000# lot a 300-500 gram sample should be taken, and a sieve analysis performed as per *Testing Sieves and Their Uses,* Handbook 53, W. S. Tyler Incorporated, Mentor, Ohio, pp. 12-17. The results should be ±2.5 percent of the following chart:

VIRGIN MEDIA
SCREENING DONE AT 2 amps AT 5 min.
INITIAL VOLUME - 300 GMS

| Screen # | Opening in Inches | Mesh | # Gms. | % of Initial Volume |
|---|---|---|---|---|
| 1 | .0331 | 20 | 0 | 0 |
| 2 | .0165 | 40 | 1 | .3% |
| 3 | .0098 | 60 | 2 | .7% |
| 4 | .0070 | 80 | 108 | 36.0% |
| 5 | .0059 | 100 | 101 | 33.6% |
| 6 | .0041 | 150 | 65 | 21.6% |
| 7 | .0029 | 200 | 17 | 5.8% |
| 8 | pan | 325 and finer | 6 | 2.0% |

-continued

VIRGIN MEDIA
SCREENING DONE AT 2 amps AT 5 min.
INITIAL VOLUME - 300 GMS

| Screen # | Opening in Inches | Mesh | # Gms. | % of Initial Volume |
|---|---|---|---|---|
| | | finer | | |

I have found that in order to be sure that proper mesh size of glass beads is being continuously used, each 40 hours of production a 300-500 gram sample should be taken from the storage hopper 4 and analyzed for size. For example, a sieve analysis should be performed as per the *Testing Sieves and Their Uses,* Handbook 53, W. S. Tyler Incorporated, Mentor, Ohio. The results of such tests should show within ±2.5 percent of the following chart:

PRODUCTION MEDIA
SCREENING DONE AT 2 amps AT 5 min.
INITIAL VOLUME 300 Grams

| Screen # | Opening In Inches | Mesh | # Gms. | % of Initial Volume |
|---|---|---|---|---|
| 1 | .0331 | 20 | 0 | 0 |
| 2 | .0165 | 40 | 0 | 0 |
| 3 | .0098 | 60 | 1 | .3% |
| 4 | .0070 | 80 | 92 | 30.6% |
| 5 | .0059 | 100 | 76 | 25.4% |
| 6 | .0041 | 150 | 46 | 15.4% |
| 7 | .0029 | 200 | 23 | 7.7% |
| 8 | pan | 325 and finer | 62 | 20.6% |

Another important parameter in accordance with my preferred method is the peening intensity, i.e., the intensity at which the glass beads strike the surface of the article. It is important for the most satisfactory result to insure a consistent operating intensity of the blast system. Therefore, it is important to prevent or detect too little intensity, which will not give proper cleaning and peening, or too much intensity which might result in the article being damaged.

I have chosen as a means to control this intensity the periodic testing of such equipment by the well known Almen gauge, testing strips and holders. Such equipment is well known and is described in the military specification MIL-S-13165. Specific test equipment to be used is the Almen gauge #2 with an Almen $N_2$ strip and an Almen strip holding fixture, all of which are well known to one skilled in the art. The test strip specimen should conform to SAE J442 and be free of carburization and decarburization to the extent that the difference in hardness between the surface in a noncarburized or decarburized depth under the surface will not be more than 2 points on the Rockwell Superficial 30 N scale. In determining flatness of the "N" specimen, measurements should be made from both faces and the results averaged. Gauges used with the standard "N" test specimens shall conform to SAE J442.

The Almen test is conducted by mounting a test strip on a holding fixture and then subjecting the strip to the same blasting by the glass beads as the articles being treated. As the result of this blasting, the strip is deformed. The deformation is then measured on an Almen gauge #2. The Almen gauge reading is to fall within the range of 0.005-0.007 inches of deformation. I have found that the test should be performed every four hours of production and the strip marked, dated, and filed for future reference.

I have also discovered in practicing my method, that some means should be provided to assure the blast equipment is properly designed to produce consistent and even exposure of all parts to the blast, thereby assuring an entirely clean batch of parts. In other words, there should be proper agitation or exposure of all the parts equally to the blast. Such proper agitation or exposure of all the parts can be obtained by loading one Almen test fixture or any discernable block of steel of a similar size and density into the tumble blast unit along with a typical batch of fasteners or other articles to be treated. With the load door open, the parts are then tumbled without blasting and as they are tumbled the number of times per minute the "block" visibly surfaces is counted. I have discovered that for proper agitation and exposure the "block" should be visible at least 15–20 times per minute.

To produce the proper agitation and exposure as above described, the tumbling unit is designed so that the parts will not lodge or come to rest in the tumbling unit. In other words, it is important that there be no areas in the tumbling unit which, under normal use, will cause the parts to miss being tumbled and blasted. As a result, the blasting guns should be adjustable in both the angular relationship and the distance to the surfaces of the tumbling parts.

OPERATION

Having described the apparatus for carrying out my invention, its operation should be quite evident. The operation starts by loading the tumbling unit with the articles to be treated. As above stated, the design of the tumbling unit and the number of articles to be treated at any one time is such that the articles are not lodged or do not come to rest in any area to cause them to either momentarily or longer be removed from the tumbling action. In other words, the articles are moving consistently in order that 100% coverage of all the surfaces on all the articles in the load is accomplished.

After the articles start to tumble, the blast guns are set into operation. These blast guns, which are adjustable in both the angular relationship to the tumbling articles and in the distance from the tumbling articles, are adjusted to blast all of the particles as evenly as possible. The blasting facility is equipped with a positive, automatic media makeup system which is represented by the reference numeral 10. Such systems are well known and are capable of replacing the glass beads on a one-to-one basis during the normal operation of the equipment.

As the articles are being tumbled and blasted, the beads after blasting the articles pass downwardly into the chutes 25 and 26 and through the duct 9 through a media classification system including the cyclone separator 8. The cyclone separator is set for removing substantially all of the sized particles which fall outside the mesh range of 70–140 as above described. Those that do not fall within this range are conveyed through the duct 14 to the dust bag house 11 where they are treated in a well known manner.

After the blasting process is completed the articles are tumbled while the blast beads are blown off the articles by blowing air through the housing. Thereafter a sifting cycle takes place, in which cycle there is tumble agitation only without blown air. During this cycle the glass beads sift downwardly through the belt into the chutes 25 and 26. After the glass beads have been separated from the articles, the articles are removed from the tumbler through door 16 by reversing the direction of the webbing and opening the door by means of cylinder 17, and the entire cycle as above described is repeated.

After the surfaces of articles are compressibly peened by the above method as accomplished by the apparatus described, they ae preferably coated by any number of well known protective coatings and by any well known method depending upon the coating being applied. Examples, of such protective coatings are Dacromet® 320, a product sold by Diamond Shamrock of Chardon, Ohio, which is an aqueous coating dispersion containing primarily chromium and zinc flakes; S2 phosphate and oil; and S36 zinc plate plus dichromate. These coatings are applied by methods recommended by the type of coating; for example, bonding by adhesion, by fusion, i.e., molecular bonding, by a chemical interacting between the coating and the surface, and by mechanical bonding. All of such coating methods are well known in the art.

MODIFICATIONS

Figure 4:
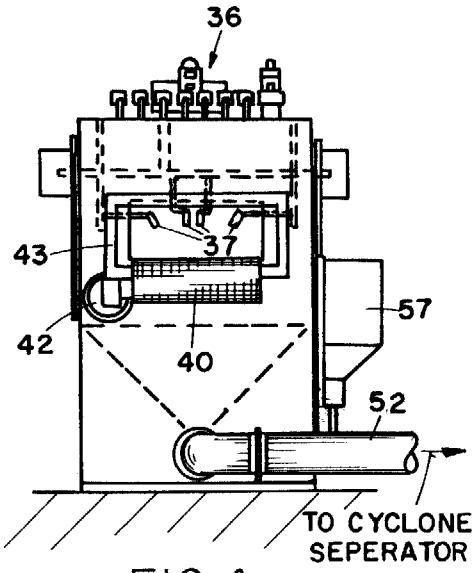
FIG. 4 is a front view of the apparatus of FIG. 3 looking in the direction of the arrows IV—IV of FIG. 3.
Figure 3:
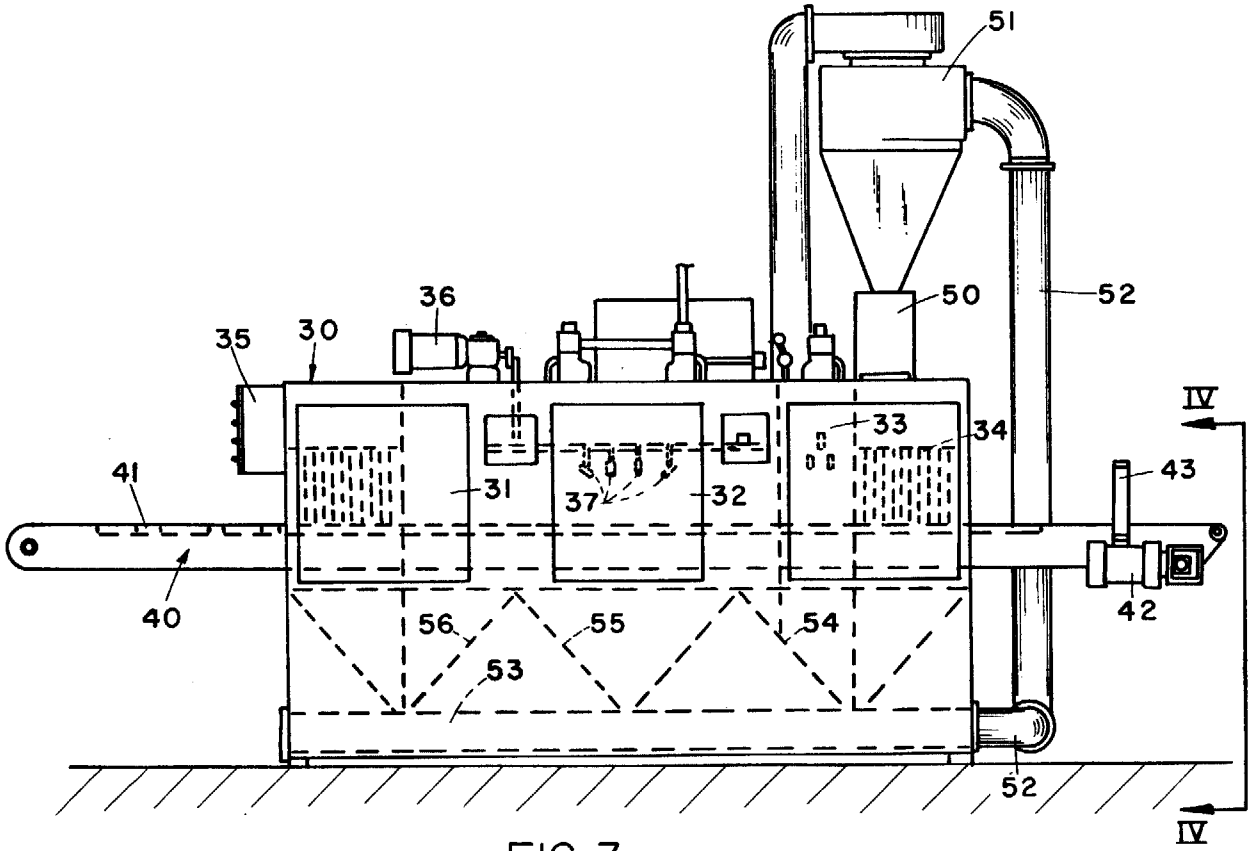
FIG. 3 is a side elevational view of a sketch of apparatus for treating larger and flatter articles in accordance with my invention.

FIGS. 3 and 4 show a modification of the apparatus of FIGS. 1 and 2. In this modification, the articles to be treated are larger and flatter so as to have a continuous even surface. They, therefore, are conveyed on a straight line conveyor past a bank of blast guns. Examples, of such parts or articles are panels for automobiles or household appliances which may or may not be flat. In other words, such parts may have contours which are continuous and even as opposed to articles such as screws or bolts which have irregular surfaces.

Specifically, FIG. 3 discloses a housing 30 in which is located an entry vestibule 31, a blast station 32, a blow off station 33, and an exit vestibule 34. Running through the entire length of housing 30 is the conveyor 40 driven by the drive assembly 42. The conveyor 40 includes bar magnets represented generally by the reference numeral 41 for holding the articles on the conveyor as they are being carried through the housing 30 and particularly while it is being blasted.

The apparatus also includes an electrical control station 35, a Pittman arm oscillating subassembly 36 for oscillating the blast guns 37 located at the blast station 32, a loop demagnetizer 48 for demagnetizing the treated articles or parts, and a virgin glass bead adder 57. The Pittman arm oscillator 36 and loop demagnetizer 43 are well known devices which need not be specifically described since they are well known to anyone skilled in the art. This equipment also has a glass bead hopper 50, a cyclone separator 51, and the duct 52 leading from the duct 53 in housing 30. The chutes 54, 55 and 56 are in communication with duct 53 for carrying off the spent glass beads during and after the blasting operation.

It should be evident from the description of the equipment in FIGS. 3 and 4 that the only difference between it and the equipment of FIGS. 1 and 2 is the handling of the articles and the orientation of the blasting equipment to the articles which are to be treated. In FIGS. 1 and 2, the articles are smaller, complicated, shaped parts, such as bolts, screws, and the like, which require tumbling for adequate exposure. The equipment of FIGS. 3 and 4 treats articles that have even, continuous surfaces that can be carried on a straight line conveyor and subjected to the glass blasting as carried along the line. It should be understood that in the treatment of different sizes and shapes of articles other equipment for blasting the same can be designed without departing from the spirit of this invention. In the operation of the equipment of FIGS. 3 and 4, the same parameters concerning the mesh of the glass beads and the intensity of the glass beads striking the parts applies.

Within the broader aspects of this invention, changes can be made in such parameters as may be required by different shapes and types of articles without departing from the spirit of this invention, it being understood that this invention is only limited as set forth in the appended claims.

The embodiments of the invention in which an exclusive property or privilege is claimed are defined as follows.

1. A method for treating an article constructed of a normally corrosive metal for the purpose of improving the anticorrosive characteristics thereof comprising the steps of dry blasting the surfaces of said article with propelled glass beads to compressibly peen the surfaces thereof without the glass beads adhering thereto, and thereafter applying a protective coating to said peened surfaces.

2. The method of claim 1 in which the glass beads are blasted against said surfaces by pneumatic propulsion.

3. The method of claim 1 in which the glass beads are of a mesh size falling within the range of 70–140 mesh.

4. The method of claim 1 in which the glass beads are of a mesh size falling within the range of 70–140 mesh and such glass beads are blasted against said surfaces by pneumatic propulsion.

5. The method of claim 1 in which the intensity of the glass beads striking the part shall be such that an Almen test strip "N" subjected to the same blasting procedure shall show an Almen gauge reading of 0.005–0.007 inches.

6. A method for treating an article constructed of a normally corrosive metal for the purpose of improving the anti-corrosive characteristics thereof comprising the steps of dry blasting the surfaces of said article with propelled glass beads to compressibly peen the surfaces thereof without the glass beads adhering thereto, said glass beads being of a mesh size falling within the range of 70–140 mesh.

7. A method for treating an article for the purpose of improving the anti-corrosive characteristics thereof, said article having a continuous even surface and constructed of a normally corrosive metal comprising the steps of dry blasting the surfaces of said article with propelled glass beads to compressibly peen the surfaces thereof without the glass beads adhering thereto, and thereafter applying a protective coating to said peened surfaces.

8. The method of claim 7 in which the glass beads are blasted against said surfaces by pneumatic propulsion.

9. The method of claim 7 in which the glass beads are of a mesh size falling within the range of 70–140 mesh.

10. The method of claim 7 in which the glass beads are of a mesh size falling within the range of 70–140 mesh and such glass beads are blasted against said surfaces by pneumatic propulsion.

11. The method of claim 7 in which the intensity of the glass beads striking the part shall be such that an Almen test strip "N" subjected to the same blasting procedure shall show an Almen gauge reading of 0.005–0.007 inches.

12. An article specifically treated for the purpose of corrosion protection comprising a substrate having a surface constructed of a normally corrosive metallic material, such surface having been compressibly peened by blasts of glass beads without the beads adhering to the said surface; and a corrosion protective surface finish on said surface.

13. The article of claim 12 in which the peened surface is of a hardness comparable to the hardness of an Almen test strip "N" measured on an Almen gauge with a reading of 0.005–0.007.

14. The article of claim 12 in which the surface was compressibly peened by blasts of glass beads of a mesh size falling within the range of 70–140 mesh.

* * * * *